United States Patent [19]

Huber et al.

[11] Patent Number: 4,719,150

[45] Date of Patent: Jan. 12, 1988

[54] MONOFILS AND BRISTLES OF HOMOPOLYMERS OR COPOLYMERS OF ACRYLONITRILE, AND A PROCESS FOR THEIR MANUFACTURE

[75] Inventors: Bernd Huber, Kelheim; Walter Fester, Saal, both of Fed. Rep. of Germany

[73] Assignee: Hoechst Aktiengesellschaft, Frankfurt am Main, Fed. Rep. of Germany

[21] Appl. No.: 827,328

[22] Filed: Feb. 7, 1986

Related U.S. Application Data

[63] Continuation of Ser. No. 704,781, Feb. 25, 1985, abandoned.

[30] Foreign Application Priority Data

Feb. 25, 1984 [DE] Fed. Rep. of Germany ..... 3406910

[51] Int. Cl.[4] ..... D02G 3/00; C08F 20/44; D01F 6/18

[52] U.S. Cl. ..... 428/397; 428/364; 428/902; 526/329.3; 526/341; 526/342; 264/182; 264/210.8; 264/342 R; 264/561

[58] Field of Search ..... 264/182, 210.7, 206, 264/210.8, 561, 342 R; 526/329.3, 341, 342; 428/364, 902, 903, 397

[56] References Cited

U.S. PATENT DOCUMENTS

| | | | |
|---|---|---|---|
| 3,878,178 | 4/1975 | Guinn et al. | 264/210.7 |
| 4,001,485 | 1/1977 | Patron et al. | 526/341 |
| 4,138,461 | 2/1979 | Reinehr et al. | 264/210 F X |
| 4,140,844 | 2/1979 | Lohwasser | 526/341 |
| 4,507,257 | 3/1985 | Fester et al. | 264/206 X |
| 4,535,027 | 8/1985 | Kobashi et al. | 264/210.7 X |

FOREIGN PATENT DOCUMENTS

| | | | |
|---|---|---|---|
| 1170011 | 7/1984 | Canada | 264/206 |

*Primary Examiner*—Joseph L. Schofer
*Assistant Examiner*—F. M. Teskin

[57] ABSTRACT

Monofils and bristles which comprise at least 90% by weight of acrylonitrile units and have a linear density of more than 2.5 tex possess a relative solution viscosity of 1.7 to 6.0, a tear strength of at least 20 cN/tex and an initial modulus of more than 700 cN/tex.

The manufacturing process is distinguished by a wet stretch of the spun filaments by at least 1:4, drying under tension and a subsequent hot stretch of at least 1:2, the overall stretch being at least 1:8, preferably 1:10 to 1:20.

The monofils and bristles according to the invention are suitable in particular for producing filament-reinforced composite materials.

5 Claims, No Drawings

MONOFILS AND BRISTLES OF HOMOPOLYMERS OR COPOLYMERS OF ACRYLONITRILE, AND A PROCESS FOR THEIR MANUFACTURE

This application is a continuation of application Ser. No. 704,781 filed Feb. 25, 1985, now abandoned.

The invention relates to monofils and bristles of polyacrylonitrile or polyacrylonitrile copolymers which are predominantly composed of acrylonitrile units and whose linear density (denier) is greater than 2.5 tex, whose strength is greater than 20 cN/tex and whose initial modulus is greater than 700 cN/tex for a 100% extension.

In the present invention, the shaped products are referred to as monofils in the case of continuous material and as bristles in the case of short-cut material in order to illustrate that they are not textile filaments or fibers in the conventional sense, but structures having diameters above 0.05 to about 0.2 mm, which corresponds to an individual linear density of greater than 2.5 tex to about 30 tex. For the purposes of the present invention it is not necessary for the monofils to have been spun out of spinnerets having only one spinneret hole. The manufacturing methods for bristles and monofils are substantially identical; for that reason simply the word filament will be used hereinafter if it is clear from the sense that it can be understood as meaning both monofils and bristles.

German Offenlegungsschrift No. 3,027,844 describes high-modulus filaments and fibers of polyacrylonitrile whose initial modulus is greater than 1,300 cN/tex. The linear densities described in the examples of this prior literature are between 1.7 and 3.6 dtex. The linear density range from about 1.5 to 15 dtex indicated in the body of the text restricts the linear density range to the customary range of textile filaments and fibers which, for an individual linear density of 15 dtex, can customarily be as high as 20 dtex in some cases and exceptionally up to 25 dtex. There is nothing in this prior literature which could have persuaded the person skilled in the art to go far beyond the linear density range and to leave the field of textile fibers and filaments.

The spinning of such coarse-denier filaments is associated with a number of difficulties. For instance, German Pat. No. 2,658,179 describes a process in which filaments having linear densities of 2 to 8 tex can be produced by a special dry-spinning process. However, the resulting filaments only have strengths of 15 to 17 cN/tex. They could only be stretched 1:2.5 times, and the elongation at break was very high (for example 97%). The areas of use mentioned for these shaped structures are the production of synthetic hair and of kemp for imitation furs. There is nothing in this prior literature directed towards the manufacture of high-modulus filaments.

The manufacture of filaments which are as similar as possible to natural human hair is also the subject-matter of German Offenlegungsschrift No. 2,434,488. According to the teaching of this prior literature, filaments within the linear density range from 2 to 7 tex are produced by a wet-spinning process. The total stretch of 1:6 takes place in 2 stages, in the wet state. The examples of this prior literature give no textile-physical values for the filaments produced. However, repeat of this work has shown that the process of German Offenlegungsschrift No. 2,434,488 can at best produce filaments which have an initial modulus of less than 600 cN/tex. As will be described hereinafter in more detail in the comparative example, it was not possible to obtain the indicated end denier of the filaments without at the same time allowing considerable shrinkage in the course of drying. Shrinkage of this kind generally has the effect of reducing the linear strength of filaments, of increasing the elongation at break and especially of lowering the initial modulus.

It is thus still the object to produce monofils and bristles of acrylonitrile polymers which are distinguished by good tenacities and in particular by a high initial modulus. It was necessary to find a manufacturing process with which these filaments could be produced.

Textile fibers and filaments of polymers having a high acrylonitrile unit content are customarily produced by solvent spinning. In this form of spinning, the solvent, which usually accounts for more than 70% of the filament emerging from the nozzle, has to be removed, and the filament-forming polymer has to be condensed into a compact filament. The difficulty of removing the solvent and of producing a compact filament increases with the thickness of the diameter of the spun filament.

It has been found, surprisingly, that it is possible to produce monofils and bristles of homopolymers or copolymers of acrylonitrile by solvent spinning and a subsequent spin into a coagulation bath, the resulting filaments which have a coarse denier, namely above 2.5 tex, being distinguished by a high initial modulus. It is common knowledge that the initial modulus is a much more sensitive measure of the ability of a filament to absorb force under low stretch than, for example, the tear strength, since it is much more sensitive to flaws in the filament structure. It was nonetheless possible to produce filaments of this type having an initial modulus of for example 1,500 or 1,700 cN/tex. Another surprise was the high stretchability of the coarse-denier filaments spun from a solution. For instance, a filament drawn out of the spinneret and having a calculated denier of 215 tex (based on the filament-forming substance)—or 1,200 tex based on the spinning material used—could be stretched a total of 16.7 times, to give a final denier of 12.9 tex.

The invention accordingly provides monofils and bristles of homopolymers or copolymers of acrylonitrile which consist to at least 90% by weight of acrylonitrile units and have a linear density of greater than 2.5 tex. These filaments have a tear strength (tenacity) of at least 20 cN/tex, preferably of more than 23 cN/tex, and an initial modulus, for 100% extension, of greater than 700 cN/tex. The polymer required therefor should have a relative viscosity, measured on a solution of 0.5 g in 100 ml of dimethylformamide at 20° C., of 1.7 to 6.0. The filaments according to the invention preferably have a linear density of greater than 2.5 to about 30 tex. In theory, assuming a circular cross-section, this corresponds to diameters of about 0.052 to 0.180 mm. Further features which are the subject-matter of the subclaims will be discussed hereinafter in detail in conjunction with the possible uses of such monofils and bristles.

The monofils and bristles of the invention are suitable, in particular, for manufacturing filament-reinforced composite materials. Compared with fibers and filaments within the textile range, i.e. having deniers below 25 generally below 15 dtex, the filaments according to the invention and in particular the bristles according to the invention can be mixed in with the materials to be reinforced in a much simpler and more homogeneous manner and in a higher concentration. The mixtures thus prepared are distinguished for example by lower viscosities and better flow properties. The preferred deniers and lengths of the filaments according to the invention depend very much upon the intended field of use and the required level in the composite material. For instance, the use of bristles of 8 to 20 tex in concrete mixes leads to an appreciable reduction of cracking in the hardened concrete elements, and it increases the resilience, reduces the brittleness and raises the energy of fracture by a considerable amount. Similar advantages can be observed when the bristles according to the invention are used to reinforce gunite concrete, mortars and various kinds of plaster.

In plastics (for example polypropylene), bristles within the linear density range from 3 to 10 tex produce particularly good reinforcing results. For instance, increased impact resistance, unlike results if glass fibers are used, is retained even at low temperatures. The same linear density range leads, for example, to particularly high dimensional stability if used in sealants based on polymer bitumen.

The optimum linear density of the bristles is very much affected by the amount of bristles used, the admixing technique and, in the case of solids, the particle size distribution of the material to be reinforced. The strengths of the filaments according to the invention are in every case above 20 cN/tex and preferably within the range from 25 to 60 cN/tex. The initial moduli of the filaments according to the invention must be above 700, preferably above 800, advantageously between 1,000 and 1,800, cN/tex. Suitable lengths range for example from 0.5 to 30 mm, while in other fields of use for the bristles they can be 100 to 150 mm. The short lengths of bristle in the region of 1 to 2 mm or below should preferably be used in mixture with filaments of greater length. However, the short lengths can have a fundamental enhancing effect on the rheological properties of, for example, building adhesives and adhesives for tiles.

If the monofils or bristles according to the invention are used in alkaline or aggressive media which are likely to affect the substance of which the filaments are made, it is advantageous to use a higher molecular weight polymer which preferably consists to more than 99% by weight of acrylonitrile units, since the filaments produced therefrom are significantly more resistant to aggressive media than the corresponding filaments made of raw materials having a high copolymer content.

The invention likewise provides a process for producing the monofils or bristles by a wet-spinning method in which a wet stretch is followed by a hot stretch after drying. In the process according to the invention, the filaments are stretched in a ratio of at least 1:4 before, during or after the wash, are dried under tension or if desired with slight shrinkage, and are then subjected to at least one hot stretch at temperatures of at least 120° C. and a stretching ratio above at least 1:2. The effective overall stretch of the filaments should be at least 1:8, preferably 1:10 to 1:20. The hot stretch is preferably a stretch in the dry-hot state in which the required heat is applied by contact neaters or hot rollers.

The polymer raw materials can be a precipitation or solution polymer prepared in conventional manner. Depending on the requirements in the fields of use, it is possible to use not only homopolymers but also copolymers of acrylonitrile. The monomers used should be as pure as possible. Any unsaturated compound which is copolymerizable with acrylonitrile is suitable as comonomer, examples thereof being as follows:

acrylamide, acrylic acid and its esters, methacrylonitrile, methacylamide, methacrylic acid and its esters and corresponding compounds substituted at the methyl group, vinyl esters and ethers, such as vinyl acetate, vinyl stearate, vinyl butyl ether, vinyl halogenoacetates, such as vinyl bromoacetate, vinyl dichloroacetate, vinyl trichloroacetate, styrene, maleinimide, vinyl halides, such as, for example, vinyl chloride, vinylylidene chloride, vinyl bromide and sulfonate-bearing unsaturated compounds and the like.

It is possible to use polymers whose relative solution viscosity, measured at 20° C. on 0.5% strength dimethylformamide solutions, is within the range from 1.7 to 6.0. As a rule, polymers having a higher molecular weight lead to filaments having better physical properties. However, their production requires the use, and recovery, of an appreciably larger amount of solvent, thereby appreciably increasing the production costs of such filaments. Good results under economic conditions are obtained with polymers which are within the viscosity range from about 1.85 to 3.5, and particularly good results are produced by polymers within the viscosity range between 2.5 and 3.5.

In the preparation of the spinning solutions, the dissolving conditions should be chosen to be such that the results are—ideally—homogeneous spinning solutions which are free of gel particles. A suitable way of checking the spinning solution quality is in particular scattered light measurement using a laser as light source. Only satisfactory spinning solutions, which have very low scattered light values, make it possible to draw to the high stretching ratios required according to the invention. The spinning solutions can be made up both continuously and discontinuously. It is possible to incorporate into the spinning solutions inorganic or organic additives, such as, for example, delusterants, stabilizers, fire-retardants and the like. Additives such as, for example, $CaCO_3$ or $Si_2$, in concentrations of 1 to 20%, which affect the surface structure are likewise suitable.

The spinning process according to the invention is distinguished by a high effective overall stretch of at least 1:8. In determining the effective overall stretch, only the wet stretch before, during or after the wash and the hot stretch are taken into account, while any shrinkage of the filaments is deducted. The values for the overall stretch do not include the so-called jet stretch; on the contrary, the freshly spun filaments obtained after any wet-spinning process are regarded as unstretched material. The effective overall stretch in the process according to the invention should be at least 1:8. Effective overall stretching ratios of 1:10 to 1:20 are preferred. The process according to the invention can be carried out on conventional filament-spinning ranges. The required effective overall stretch is effected in a plurality of stages, starting with a wet stretch of at least 1:4 in one or, stepwise, more hot baths before, during or after the residual solvent content is washed out. The temperature of the stretching bath media, which, as a rule, comprise mixtures of water and the aprotic solvent used, should be as high as possible. Temperatures a little below the boiling point of the bath fluid are preferred. However, it is also possible to use baths which contain other stretching bath media, for example glycol or glycerol in the absence or presence of the polymer solvent, where it is also possible to use stretching temperatures above 100° C.

After the stretch and the residual solent content has been washed off, the filaments are spin-finished in a spin finish bath and thereafter are freed in conventional manner from as much of the surface water as possible through the action of rotating pairs of squeeze rollers. The spin finish applied in the spin finish bath can have an effect on the stretching properties of the filaments. For that reason it is necessary to select from among known spin finish mixtures, the mixture which produces the relatively lowest fiber friction.

Immediately after the application of spin finish the resulting filaments are dried under tension on hot rollers. It is possible to allow a slight shrinkage, which frequently turns out to be advantageous for the subsequent stretch, to take place during the drying; however, in setting the degree of shrinkage care must be taken to ensure that the tow is always under tension as it passes over the drying rollers. The temperatures of the rollers should be chosen so as to ensure that, as the tow leaves the dryer, it has a very low residual moisture content, namely—ideally—of less than 1%. Temperatures of 140° to 240° C. for the drying rollers have been found to be particularly advantageous, yet this does not rule out the use of higher or lower temperatures. Similarly, the drying can be carried out on rollers having stepped temperatures.

After drying the tow is stretched once more to at least twice its length using dry heat. This stretch can likewise take place in one or more stages. The tow can be heated up by one of the industrially customary methods, for example by passing around hot rollers, by contact with hot plates, in a hot-air duct or even by radiation, in particular infrared radiation. It is also possible to use a stagewise stretch in which various heating methods are used. Combinations of this type are particularly advantageous whenever stretching takes place in the first stretching stage by means of or between hot rollers and one of the three other methods described is used in the second stage. The stretching temperatures are affected by the nature of the polymer used and partly by the preceding stretch and the drying conditions. In general, drying temperatures within the range from about 120° to 250° C. are suitable.

After the stretch the filaments are cooled down in conventional manner and, using known methods, are either wound up as continuous filament material or cut into bristles of the desired length. If so required by the intended use, a special finish can be applied to the monofilaments or bristles before or after the cut to enhance, for example, the dispersibility or the adhesion in a composite material.

The following examples serve to illustrate the invention. Unless otherwise stated, the percentages and parts are by weight.

EXAMPLE 1

A 19% strength solution of a polymer of 99.3% of acrylonitrile and 0.7% of methyl acrylate with a relative viscosity (measured at 20° C. on a solution of 0.5 g in 100 ml of dimethylformamide) of 3.0 was forced through a 1,000-hole (hole diameter 0.12 mm) spinneret into a coagulation bath at 40° C. of 43.8% dimethylformamide (DMF) and 56.2% water, and the filaments were drawn off the jet vertically upward at 6.3 m/min, were then stretched at the boil in two baths containing 33% of DMF and 67% of water to 29 m/min, were washed with hot water in countercurrent formation, shrinkage to 27 m/min being allowed, were then spin-finished and dried on hot drums at 170°, 190° and briefly at 230° C., were cooled down to 180° C. and were stretched to 74 m/min over hot plates at 180° C. The effective overall stretch was 1:11.7. The resulting filaments had the following properties:

| | |
|---|---|
| Linear density | 2.6 tex |
| Tear strength | 45 cN/tex |
| Elongation at break | 7.5% |
| Initial modulus | 1,515 cN/tex |

The measurements were recorded using an Instron 1122 tensile tester. The clamped length was 200 mm, and extension took place at a speed of 100% of the clamped length per minute. The initial modulus was determined within the extension range from 0.1 to 0.3%.

EXAMPLE 2

A spinning composition as described in Example 1 was forced through a 500-hole (hole diameter 0.15 mm) spinneret at 34° C. into a coagulation bath of 43% of DMF and 57% of water. The resulting filaments were drawn vertically off the spinneret at 6.3 m/min, were stretched to 27 m/min at the boil in two successive troughs filled with a mixture of 40% of DMF and 60% of water, were washed in hot water in countercurrent, were spin-finished, were dried at 170°, 190° and briefly at 230° C. and were then stretched initially to 40 m/min at 180° C. and then over hot plates at 180° C. to 78 m/min. The effective overall stretch was 1:12.4. The resulting filaments had the following properties:

| | |
|---|---|
| Linear density | 4.96 tex |
| Tear strength | 41 cN/tex |
| Elongation at break | 7.0% |
| Initial modulus | 1,445 cN/tex |

EXAMPLE 3

An 18% strength spinning composition of a polymer as described in Example 1 was forced through a 10-hole (hole diameter 0.3 mm) spinneret at 39° C. into a coagulation bath of 40% of DMF and 60% of water. The filaments were drawn off the spinneret at 4.5 m/min, were stretched to 22.5 m/min at 95° C. in two baths containing 60% of DMF and 40% of water, were washed in hot water and, after passing through a spin finish bath, were dried under tension on 2 godets at temperatures of 150° and 190° C. Using a third godet, heated to 190° C., the filaments were stretched to 42 m/min and were then drawn off this godet at 67.0 m/min. The overall stretch was 1:14.9. The filaments had the following properties:

| | |
|---|---|
| Linear density | 6.5 tex |
| Tear strength | 49 cN/tex |
| Elongation at break | 6.1% |
| Initial modulus | 1,656 c/N tex |

EXAMPLE 4

A spinning composition as described in Example 3 was forced through a 10-hole (hole diameter 0.5 mm) spinneret into a coagulation bath at 30° C. comprising 38% DMF and 62% water, and filaments were drawn off at 4.5 m/min, were then stretched to 22.5 m/min in two troughs containing 58% of DMF and 42% of water at 95° C., washed with hot water, were spin-finished, were dried on 3 godets at 150°, 160° and 180° C., were stretched to 32.2 m/min using a fourth godet, heated to 190° C., and were drawn off this godet at 75 m/min. The overall stretch was 1:16.7. The filaments thus obtained had the following properties:

| | |
|---|---|
| Linear density | 12.9 tex |
| Tear strength | 38 cN/tex |
| Elongation at break | 6.8% |
| Initial modulus | 1,304 cN/tex |

EXAMPLE 5

A spinning composition as described in Example 3 was spun into filaments under the conditions of Example 4, which were wet-stretched, washed and spin-finished. The drying took place on 3 godets at 150°, 160° and 180° C. surface temperature. The tow was stretched to 42 m/min using a hot godet at 205° C. and was drawn off this godet at 59 m/min (overall stretch 1:13.1). The resulting filaments had the following values:

| | |
|---|---|
| Linear density | 16.2 tex |
| Tear strength | 34 cN/tex |
| Elongation at break | 8.3% |
| Initial modulus | 1,162 cN/tex |

EXAMPLE 6

A 26% strength spinning composition of a polymer of 93.5% by weight of acrylonitrile, 6% of methyl acrylate and 0.5% of sodium methallylsulfonate, which had a relative viscosity of 1.92, was forced through a 10-hole (hole diameter 0.5 mm) spinneret into a coagulation bath which comprised 30% of DMF and 70% of water at 32° C. The filaments were drawn off the spinneret at 3.5 m/min, were stretched to 22.6 m/min in two successive baths comprising 60% DMF and 40% water at 95° C., were washed in hot water at 80° C., were spin-finished, and were dried on 4 godets at 135°, 150°, 165° and 170° C. The speeds of the individual godets were: 22.5, 24.8, 24.5 and 22.5 m/min. The filaments were drawn off the last godet at 48.0 m/min, so that the effective overall stretch was 1:13.7. The resulting filaments had the following properties:

| | |
|---|---|
| Linear density | 19.1 tex |
| Tear strength | 24 cN/tex |
| Elongation at break | 7.3% |
| Initial modulus | 879 cN/tex |

EXAMPLE 7 (COMPARISON)

This example is a repeat of the essential matter in Example 1 of German Offenlegungsschrift No. 2,434,488. A 22% strength solution of a polymer of 93.6% by weight of acrylonitrile, 5.8% by weight of methyl acrylate and 0.6% of sodium methallylsulfonate in DMF was spun through a 10-hole (hole diameter 0.3 mm) spinneret (spinneret diameter 20 mm) into a coagulation bath of 55% of DMF and 45% of water at 20° C. The ejection speed of the spinning composition was set to 6.0 m/min, and the filaments were drawn off the spinneret at 4.8 m/min (jet stretch ratio: 0.8). The filaments were stretched to 24 m/min in a bath containing 50% of DMF and 50% of water at 90° C., were washed with hot water in countercurrent, were restretched to 28.8 m/min in water at the boil, were spin-finished and were dried with no allowed shrinkage. The effective overall stretch was 1:6, as in said example of the prior literature. The filaments obtained under these conditions has the following properties:

| | |
|---|---|
| Linear density | 3.46 tex |
| Tear strength | 23 cN/tex |
| Elongation at break | 13% |
| Initial modulus | 583 cN/tex |

The initial modulus was determined within the range from 0.3 to 0.5% extension, since the values within the range 0.1 to 0.3% were lower. The linear density value was the average of linear density measurements on all 10 filaments. It was impossible in this way to obtain a linear density of 4 tex. For that reason the spinning experiment of Example 7 was repeated, except that the filaments were wound up at 27.0 m/min after drying at 180° C. Under these conditions the following physical values resulted:

| | |
|---|---|
| Linear density | 3.65 tex |
| Tear strength | 22 cN/tex |
| Elongation at break | 17% |
| Initial modulus | 509 cN/tex |

In this instance too the initial modulus was determined within the range 0.3 to 0.5% extension.

In this variant it was likewise still not possible to obtain a linear density of 4.0 tex. Presumably, even greater shrinkage was allowed in the process described in Example 1 of German Offenlegungsschrift No. 2,434,488 than indicated above. Yet, that also means that the filaments of this Example 1 certainly also had an even lower tear strength and that in particular the initial modulus must have been markedly below 500 cN/tex.

We claim:

1. A monofil or a bristle of a homopolymer or copolymer of acrylonitrile consisting of at least 90% by weight of acrylonitrile units and having a relative viscosity, as measured in a solution of 0.5 g of the polymer in 100 ml of dimethylformamide at 20° C., of 1.7 to 6.0, and the monofil or bristle having a tear strength (tenacity) of from 20 to 60 CN/tex and an initial modulus, for 100% extension, of more than 700 to 1,800 cN/tex and a linear density (denier) of from 2.5 to about 30 tex.

2. The monofil or bristle as claimed in claim 1 wherein the relative viscosity of the acrylonitrile polymer is between 2.5 and 3.5.

3. The monofil or bristle as claimed in claim 1 wherein the copolymer comprises at least 99% by weight of acrylonitrile units.

4. In a process for producing a monofil or bristle of a homopolymer or copolymer of acrylonitrile as claimed in claim 1, in which monofils or bristles are produced by solvent spinning and subsequent spinning into a coagulant bath, with a wet stretch followed by a hot stretch in steps comprising preparing a spinning solution of the polymer in an aprotic solvent, spinning the solution into a coagulation bath, wet-stretching the resulting filaments at a stretch ratio of at least 1:4, the wet stretching being carried out before, during or after a washing out of the residual solvent, drying the thus stretched filaments under tension and then subjecting the filaments to at least one hot stretch at temperatures above 120° C. in a stretching ratio of at least 1:2, the effective overall stretch being at least 1:8.

5. The process as claimed in claim 4 wherein the filaments are stretched with slight shrinkage.

* * * * *